United States Patent [19]

Ide

[11] 3,945,674

[45] Mar. 23, 1976

[54] LOAD-RETAINING APPARATUS

[75] Inventor: Allan R. Ide, Cypress, Calif.

[73] Assignee: Metropolitan Stevedore Company, Wilmington, Calif.

[22] Filed: Jan. 22, 1975

[21] Appl. No.: 543,038

[52] U.S. Cl. ..... 294/67 R; 294/67 EA

[51] Int. Cl.[2] ..... B66C 1/16

[58] Field of Search ..... 294/63 R, 67 R, 67 AB, 294/67 B, 67 BC, 67 D, 67 DA, 67 DB, 67 E, 67 EA, 74, 77; 108/51, 52, 54, 55, 58; 206/386; 214/10.5 R; 220/1.5

[56] References Cited

UNITED STATES PATENTS

| | | | |
|---|---|---|---|
| 1,401,206 | 12/1921 | Swartz | 294/67 EA X |
| 1,931,931 | 10/1933 | Mueller | 294/67 EA |
| 3,332,716 | 7/1967 | Gridley | 294/67 R |
| 3,603,635 | 9/1971 | Ide | 294/67 D |

*Primary Examiner*—Evon C. Blunk
*Assistant Examiner*—Johnny D. Cherry
*Attorney, Agent, or Firm*—Fulwider, Patton, Rieber, Lee & Utecht

[57] ABSTRACT

A load-retaining apparatus including a pallet floor having an upstanding cage mounted thereon for receipt within of a load carried on such pallet floor. A horizontally projecting retainer is provided for resting on such load to hold it captive and is carried from such cage by means of pivotable lifting arms coupled with a hoisting device in such a manner that hoisting of the cage causes such arms to rotate and automatically lower the retainer onto such load. When the pallet subsequently comes to rest on the ground and tension is taken off this hoisting device, the arms are biased to their retracted positions to raise the retainer off such load.

7 Claims, 4 Drawing Figures

LOAD-RETAINING APPARATUS

BACKGROUND OF THE INVENTION

1. Field of the Invention

The present invention relates to a device for holding loosely stacked cargo on a pallet floor while such pallet is maneuvered about, as for instance while it is transferred from a dock to the hold of a cargo ship.

2. Description of the Prior Art

In my issued U.S. Pat., No. 3,603,635, I note that many prior art load holding devices are relatively cumbersome and do not provide for automatic release of the load upon lowering of the pallet to ground level. The device disclosed in that patent itself incorporates a cage carried on a pallet and having a horizontally projecting load holder carried from such cage by means of retraction posts which engage the ground upon lowering of such cage to raise the holder off the load.

SUMMARY OF THE INVENTION

The load-retaining apparatus of the present invention incorporates lifting arms pivotally mounted from the upper portion of a cage mounted on a load-receiving pallet. Suspended from the free ends of such arms is a load retainer and the arms themselves are biased to their retracted position holding such retainer elevated above the load itself. A hoisting device is connected with the arms and is operable upon hoisting thereof to rotate such arms and lower the retainer onto such load to retain the load securely on the pallet while such pallet is maneuvered about.

DESCRIPTION OF THE PREFERRED EMBODIMENT

Figure 1:
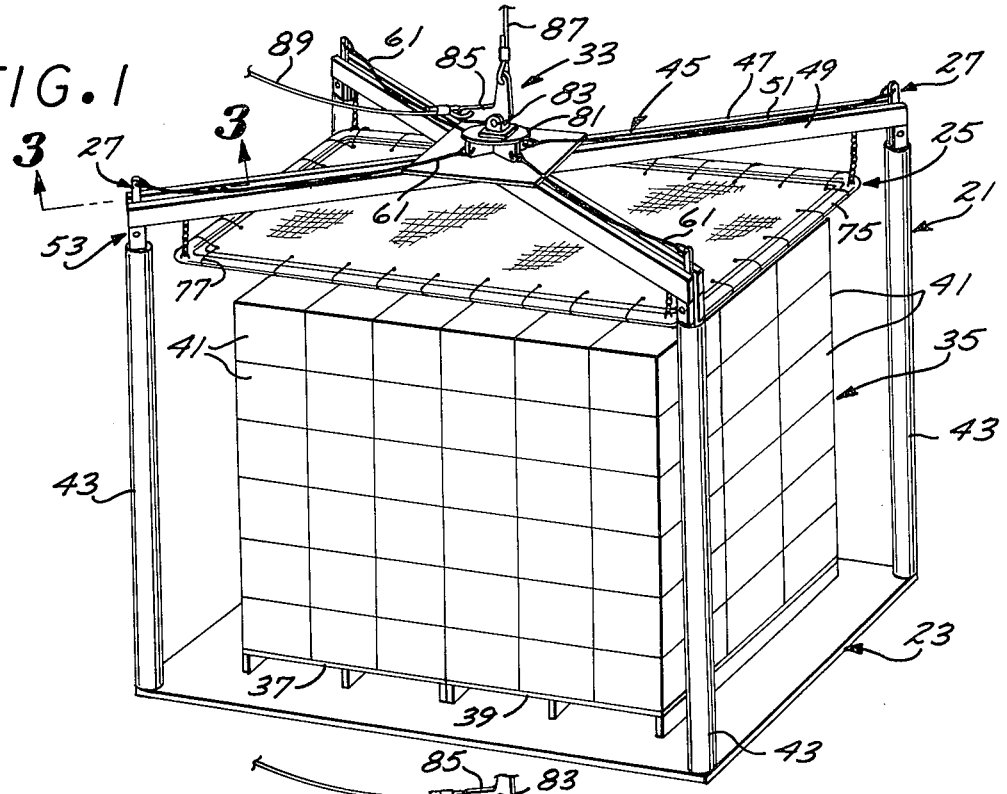
FIG. 1 is a perspective view of a load-retaining apparatus incorporating the present invention and depicting the retainer thereof retracted.
Figure 3:
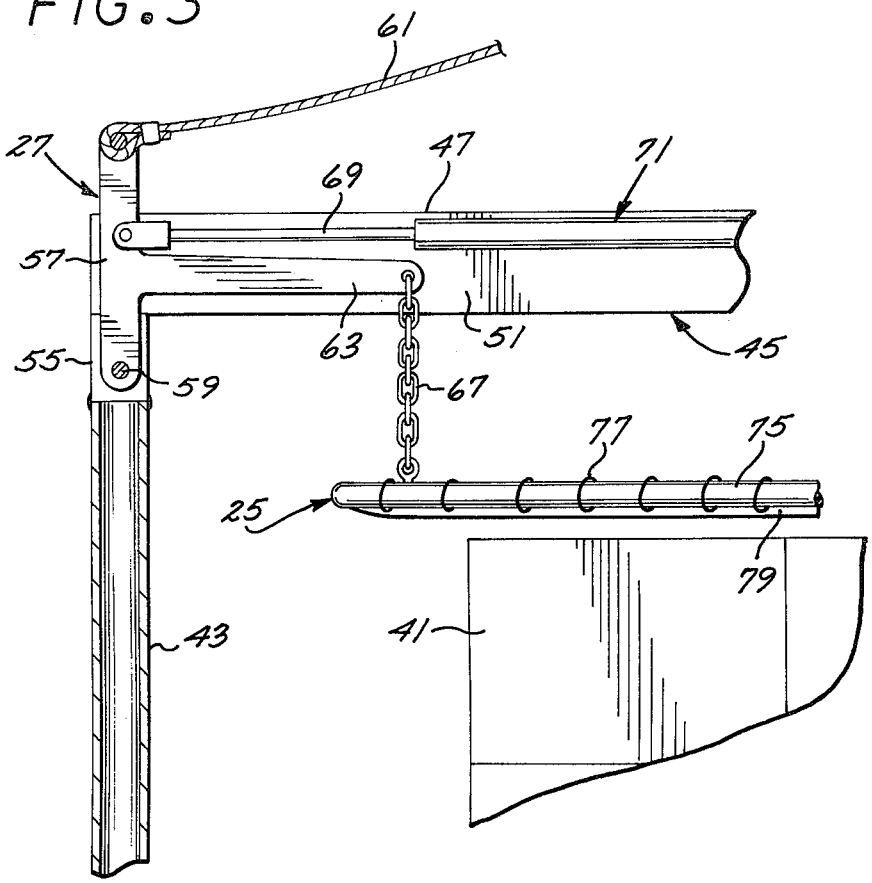
FIG. 3 is a sectional view, in enlarged scale, taken along the line 3—3 of FIG. 1.
Figure 4:
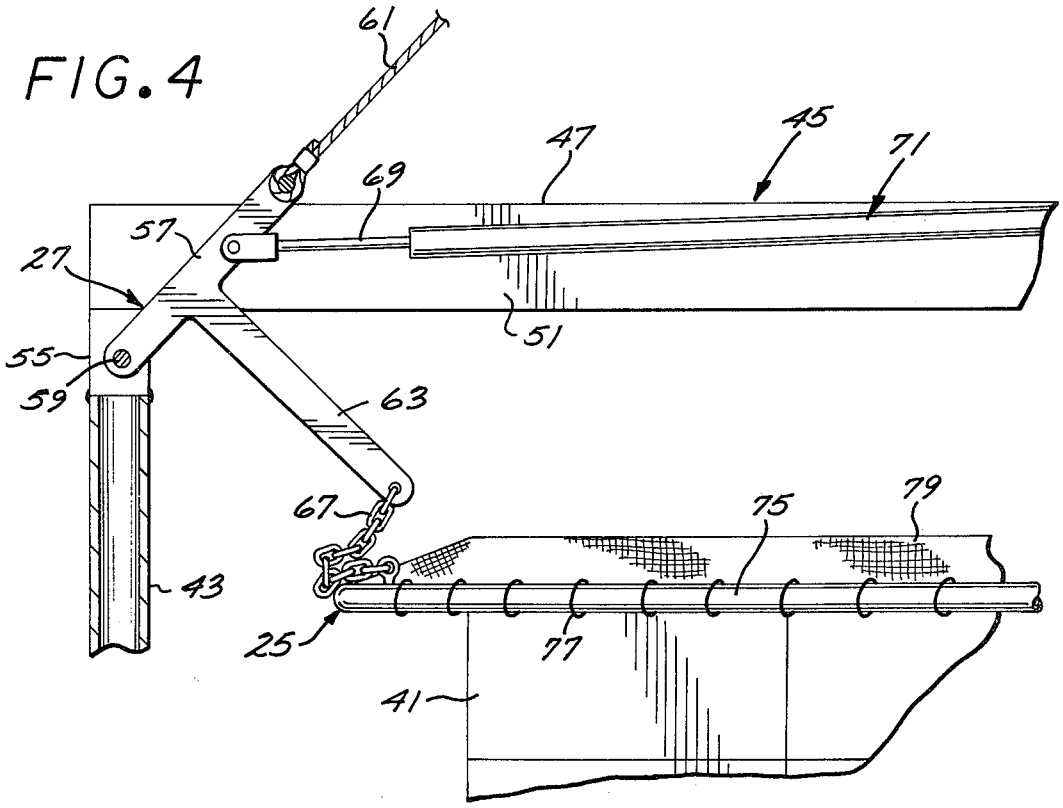
FIG. 4 is a sectional view, in enlarged scale, taken along the line 4—4 of FIG. 2.

Referring to FIGS. 1 and 3, the load-retaining apparatus of the present invention includes, generally, a four-cornered cage 21 mounted on a rectangular pallet floor 23 and having a rectangular horizontally disposed retainer 25 suspended therefrom. Referring to FIG. 3, the retainer 25 is suspended in vertically shiftable relationship from such cage 21 by means of pivotally mounted bell crank shaped lifting arms 27. The lifting arms 27 are connected with a hoisting device 33 which is operative upon hoisting upwardly thereof to actuate the retainer 25 by rotating the lifting arms 27 from their retracted positions shown in FIG. 3 to the retaining position shown in FIG. 4 to thereby lower such retainer onto the top of a load, generally designated 35, carried on the pallet floor 23 to retain such load securely on the pallet while such pallet is moved about.

The pallet floor 23 is in the form of a flat bottom wall and may have forklift pallets 37 and 39 positioned directly thereon. It is common practice to store citrus fruit and the like in a plurality of individual boxes 41 which may be conveniently stored on the pallets 37 and 39 for ready movement thereof.

The cage 21 is in the form of four upstanding posts 43 mounted at the four corners of the pallet floor 23 and having criss-cross beams, generally designated 45, projecting diagonally between the tops of the respective posts at the opposite corners of such pallet to form the top of the cage 21. The beams 45 are formed from side-by-side strips 47 and 49 which are spaced apart to form therebetween longitudinal passages 51. The beams 45 themselves are carried from the tops of the posts 43 by means of mounting brackets, generally designated 53, and formed by side-by-side plates 55 (FIG. 4) which are likewise spaced apart for receipt therebetween of the respective lifting arms 27.

The lifting arms 27 are generally T-shaped with the tops of the T's forming respective first legs 57 mounted at their lower extremities from the respective brackets, or plates, 55 by means of respective pivot pins 59 (FIG. 3). The upper ends of the respective first legs 57 are connected with the hoisting device 33 (FIG. 2) by means of respective cables 61. Still referring to FIGS. 3 and 4, the second legs 63 of the respective lifting arms 27 form free extremities which are connected with the respective corners of the retainer 25 by means of respective short lengths of chain 67. The upper intermediate portion of the respective first legs 57 are connected with the plungers 69 of respective retraction cylinders, generally designated 71, which incorporate compression springs (not shown) and are connected on their housing ends with the respective central portion of the respective beams 45.

Figure 2:
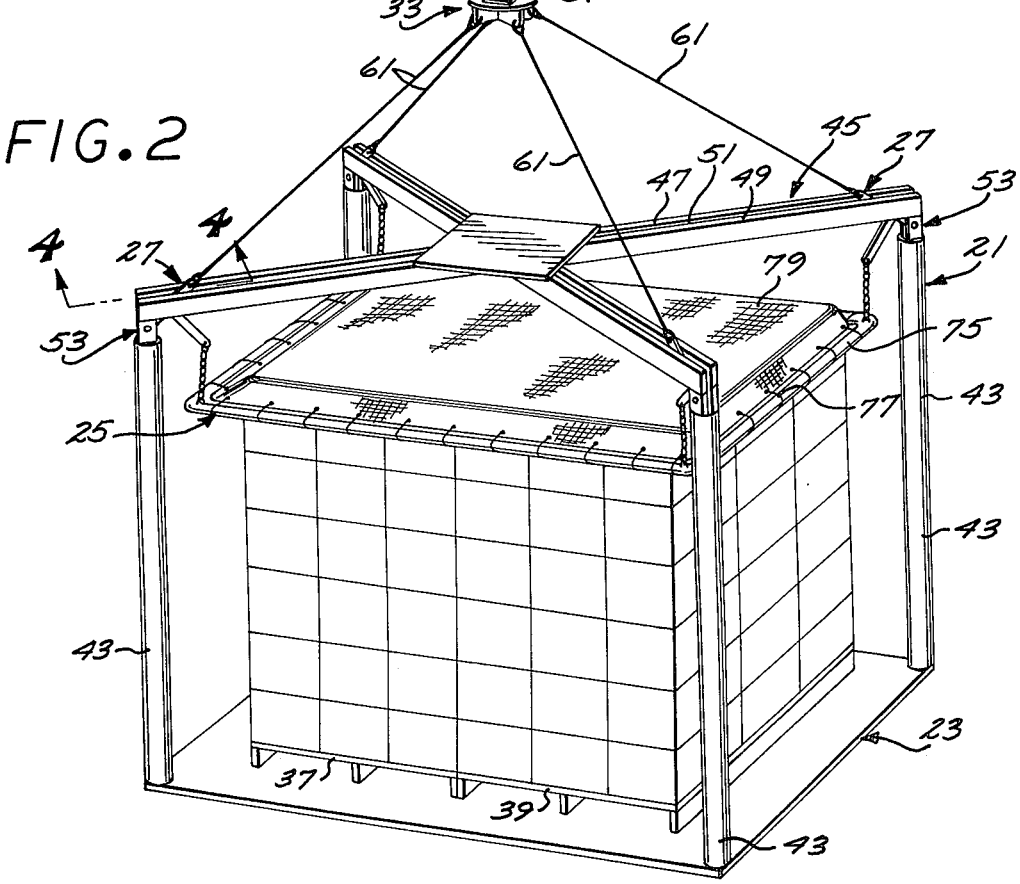
FIG. 2 is a perspective view of the load-retaining apparatus shown in FIG. 1, but showing the retainer in a retaining position.

Referring to FIGS. 1 and 2, the retainer 25 is somewhat in the form of a trampoline and is formed with a rectangular frame 75 having suspended therefrom by means of peripheral loops 77 a netting 79.

Still referring to FIGS. 1 and 2, the hoisting device 33 includes a central fitting 81 to which the cables 61 are connected. The top side of the fitting 81 is formed with an upwardly opening clevis 83 having an L-shaped hoisting bracket 85 pivotally mounted thereon. The hoisting bracket 85 has a hoisting cable 87 attached to one extremity thereof and a guide cable 89 attached to the opposite extremity thereof.

In operation, it is common practice for a cargo ship to carry hoisting booms from their decks and to feed hoisting dable 87 from such booms for coupling with cargo to be hoisted on board the ship. Thus, the retaining apparatus itself will normally be positioned on the dock adjacent the ship to be loaded and forklift trucks will bring the ladened forklift pallets 37 and 39 onto the dock and position such pallets on the pallet floor 23. It will be appreciated that during loading of the pallet floor 23 the hoisting device 33 is in its lowered position shown in FIG. 1 thus releasing tension in the cables 61 to enable the respective cylinders 71 (FIG. 3) to urge the upper ends of the lifting arm legs 57 to the left to rotate such lifting arms counterclockwise, thus maintaining the retainer 25 raised to its elevated position shown in FIG. 3, thereby providing room thereunder for positioning the ladened forklift pallets 37 and 39 on the pallet floor 23.

However, once the retaining apparatus has been loaded, the ship's hoist will be actuated to apply tension to the hoisting cable 87 thus raising the central fitting 81 to the position shown in FIG. 2 and applying tension to the cables 61. Tightening of the cables 61 will draw the upper extremities of the vertically projecting lifting arm legs 57 inwardly to rotate such lifting arms about their respective pivot pins 59 against the bias of the respective cylinders 71 to thus lower the free extremities of the second legs 63 thereby bringing the retainer 25 to rest on the boxes 41. With the full weight of the retainer 25 applied to the top of the composite load of boxes 41, the frame 75 will be lowered below the level of the top of such boxes thus drawing the net 79 downwardly over the edges thereof and urging such boxes inwardly toward one another to be maintained in their retained condition. Continued hoisting on the hoisting cable 87 will then lift the retaining apparatus off the dock to swing it over the deck and lower it into the ship's hold. Once the retaining apparatus comes to rest within the ship's hold and tension is released on the hoisting device 33, the respective lifting arms 27 will be rotated counterclockwise as viewed in FIG. 4 to thus raise the free ends of the legs 63 to the position shown in FIG. 3 thereby lifting the retainer 25 off the boxes 41 to thus free such boxes for removal from thereunder. The forklift pallets 37 and 39 may then be removed from the pallet floor 23 and the empty load-retaining apparatus removed from the hold and returned to the dock for a new load of cargo.

From the foregoing it will be apparent that the load-retaining apparatus of the present invention provides a convenient and effective means for retaining a load in position on a pallet floor while such pallet is moved about.

Obviously, many modifications and variations of the present invention may be made with regard to the foregoing detailed description without departing from the spirit of the invention.

I claim:

1. Load-retaining apparatus comprising:

a pallet floor for receiving a predetermined load;

a cage mounted on said pallet floor;

a horizontally projecting vertically shiftable retainer for resting on the top of said load to hold it captive on said pallet floor;

lifting arms pivotally mounted on their respective one extremities from said cage and formed on their opposite extremities with respective free ends;

connectors connecting said free ends with said retainer;

retraction means normally retracting said lifting arms to their retracted positions with said free ends thereof holding said retainer elevated from said load;

a hoist device liftable to lift said pallet floor; and actuating means connected between said hoist device and lifting arms and operable upon hoisting of said hoist device to overcome said retraction means to rotate said lifting arms to lower said free ends to lower said retainer onto said load.

2. Load-retaining apparatus as set forth in claim 1 wherein:

said lifting arms are formed with respective first legs projecting vertically upwardly from the points of pivotal connection thereof with said cage when in said retracted positions, and second legs projecting horizontally inwardly within said cage from said respective first legs to define the respective free ends; and said hoisting device includes actuating cables connected with the upper portions of said respective first legs and operative upon hoisting thereof to draw inwardly on the upper extremities of said first legs.

3. Load-retaining apparatus as set forth in claim 2 wherein:

said connectors include respective chains connected between said free ends and said retainer.

4. Load-retaining apparatus as set forth in claim 2 wherein:

said retraction means includes respective cylinders biasing said lifting arms about their respective pivotal mounting points to urge said arms to their respective retracted positions.

5. Load-retaining apparatus as set forth in claim 1 wherein:

said connectors include respective chains connected between said free ends and said retainer.

6. Load-retaining apparatus as set forth in claim 1 wherein:

said retraction means includes respective cylinders biasing said lifting arms about their respective pivotal mounting points to urge said arms to their respective retracted positions.

7. Load-retaining apparatus as set forth in claim 1 wherein:

said hoisting device includes a central fitting for connection to a hoisting line; and a plurality of cables connected on their respective one extremities with said central fitting and on their respective opposite extremities with said lifting arms and operable upon hoisting of said central fitting by said hoisting line to rotate said lifting arms to lower said free ends and engage said retainer with said load.

* * * * *